US005564160A

United States Patent [19]

Luebbering

[11] Patent Number: 5,564,160

[45] Date of Patent: Oct. 15, 1996

[54] VACUUM CLEANER HAVING FORWARDLY CURVED HANDLE

[75] Inventor: Gregory W. Luebbering, Bloomington, Ill.

[73] Assignee: White Consolidated Industries, Inc., Cleveland, Ohio

[21] Appl. No.: 372,361

[22] Filed: Jan. 13, 1995

[51] Int. Cl.[6] ..... A47L 5/00; A47L 9/32

[52] U.S. Cl. ..... 15/351; 15/323; 15/410

[58] Field of Search ..... 15/350, 351, 354, 15/355, 356, 357, 358, 359, 360, 361, 410

[56] References Cited

U.S. PATENT DOCUMENTS

| | | | |
|---|---|---|---|
| 1,918,519 | 7/1933 | Clements | 15/410 |
| 3,220,043 | 11/1965 | Lampe | 15/354 |
| 4,249,280 | 2/1981 | Goodrich | 15/410 |
| 4,467,493 | 8/1984 | Buchtel | 15/410 |
| 4,683,607 | 8/1987 | Lackner | 15/410 |
| 4,720,890 | 1/1988 | Jacob . | |
| 5,016,315 | 5/1991 | Bledsoe et al. . | |
| 5,233,722 | 8/1993 | McKnight | 15/351 |
| 5,247,719 | 9/1993 | Wareham | 15/351 |
| 5,303,447 | 4/1994 | McKnight | 15/323 |

FOREIGN PATENT DOCUMENTS

| | | | |
|---|---|---|---|
| 725344 | 1/1966 | Canada | 15/410 |
| 6407374 | 12/1965 | Netherlands | 15/410 |

*Primary Examiner*—David Scherbel
*Assistant Examiner*—Randall E. Chin
*Attorney, Agent, or Firm*—Pearne, Gordon, McCoy & Granger

[57] ABSTRACT

An upright vacuum cleaner having a handle pivotally connected to a rear portion of a surface cleaning brush housing. A lower portion of the handle is relatively straight and an upper portion of the handle curves forwardly therefrom so that the cleaner may be operated with greater ease and the housing may be operated under articles of furniture without undue stooping by the user. With the handle in an upright position, the cleaner occupies a smaller floor area as compared to conventional cleaners.

2 Claims, 4 Drawing Sheets

Fig.6
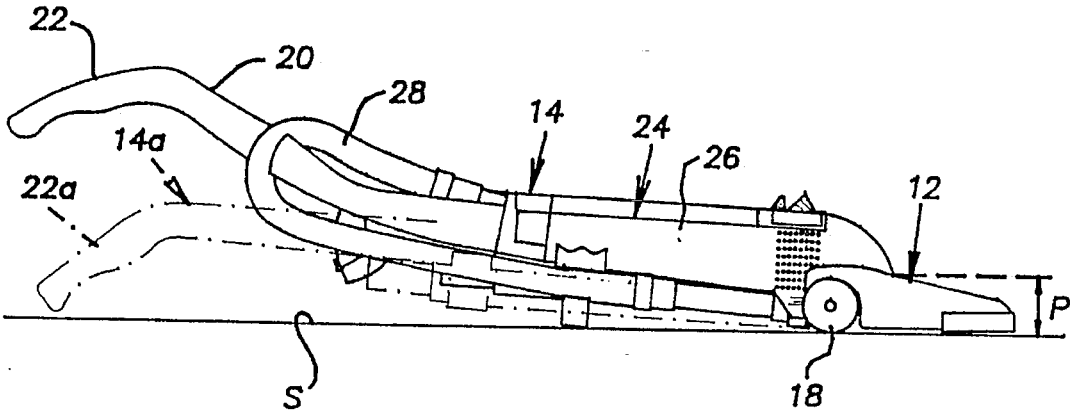
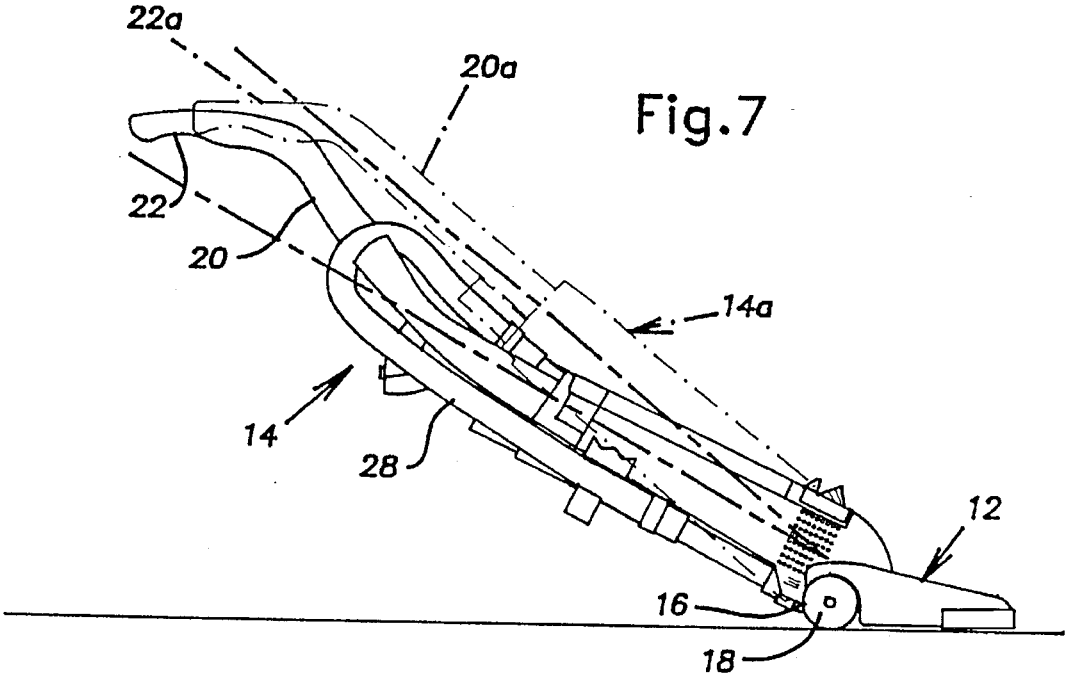
Fig.7

VACUUM CLEANER HAVING FORWARDLY CURVED HANDLE

BACKGROUND OF THE INVENTION

This invention relates to upright vacuum cleaners and, more particularly, to an ergonomically-designed handle for a vacuum cleaner which enables the user to operate the cleaner with a more efficient stroke, which enables the user to vacuum under articles of furniture without undue bending or stooping, and which enables the cleaner to be stored in a relatively small area.

Conventional upright vacuum cleaners generally comprise a wheeled, floor-engaging suction housing which includes a powered brush roll. A handle is pivotally connected to a rear portion of the housing, and the handle extends in a generally rectilinear direction to a hand grip. Upright vacuum cleaners may have a handle which is merely a tube with a hand grip at its end. These cleaners usually have a soft filter bag cover attached at the lower end to the blower outlet of the suction housing and attached at the upper end to an upper portion of the handle. Other handle arrangements may comprise more stylized configurations, such as flat, relatively wide handles which taper toward the hand grip, rather than the conventional tube handle. Other handles include a canister or hard box which forms a chamber for a filter bag. The elongated chamber is pivoted at one end to the suction housing and includes an upper post portion which extends to a hand grip.

During use, the handle portion of the cleaner exhibits an acute angle with respect to the floor. When the acute angle is relatively small, more of the user's energy is directed to moving the cleaning head in the desired direction toward or away from the user. It is also easier to steer the suction housing when this angle is small. Furthermore, it is necessary to lower the handle to a substantially horizontal position when cleaning under low clearance items of furniture. This necessitates stooping or bending to obtain such a handle position. Prior art handle grips have been designed to effectively lower the position of the handle during normal usage, but the degree to which the handle is lowered is minimal. Examples of such handles may be found in U.S. Pat. Nos. 4,720,890 and 5,016,315.

SUMMARY OF THE INVENTION

This invention provides an upright vacuum cleaner which has a handle exhibiting a relatively small acute angle with respect to the floor during normal usage and which enables the user to effectively vacuum under low clearance furniture items without exaggerated stooping or bending. According to this invention, an upright vacuum cleaner comprises a wheeled, floor-engaging suction housing and a handle having a lower portion pivotally connected to a rear portion of the suction housing. The suction housing has a relatively low vertical profile for ease of cleaning under articles of furniture. A lower portion of the handle is relatively straight and has a longitudinal axis. An upper portion of the handle curves or slants forwardly and has a hand grip portion at its end angularly related to a path of curvature of the upper portion. The handle is pivotable between a fully upright position with the longitudinal axis of the lower handle portion in a substantially vertical position, and a fully lowered position with the longitudinal axis in a substantially horizontal position. The hand grip portion is positioned substantially vertically above the front edge of the suction housing with the handle in the upright position and at a level substantially above the vertical profile of the housing with the handle in the horizontal position. The lower portion of the handle defines a rigid chamber for receiving material from the suction housing and includes a disposable filter. A rear portion of the rigid chamber has a tool caddy defining a series of pockets for storage of on-board tools.

BRIEF DESCRIPTION OF THE DRAWINGS

FIG. 6 is a side view of the vacuum cleaner illustrating the handle in a fully lowered condition illustrating a conventional handle superimposed thereon and in phantom outline; and FIG. 7 is a side view of the cleaner showing the handle in a normal operating position illustrating a conventional handle superimposed thereon and in phantom outline.

DETAILED DESCRIPTION OF THE INVENTION

Figure 1:
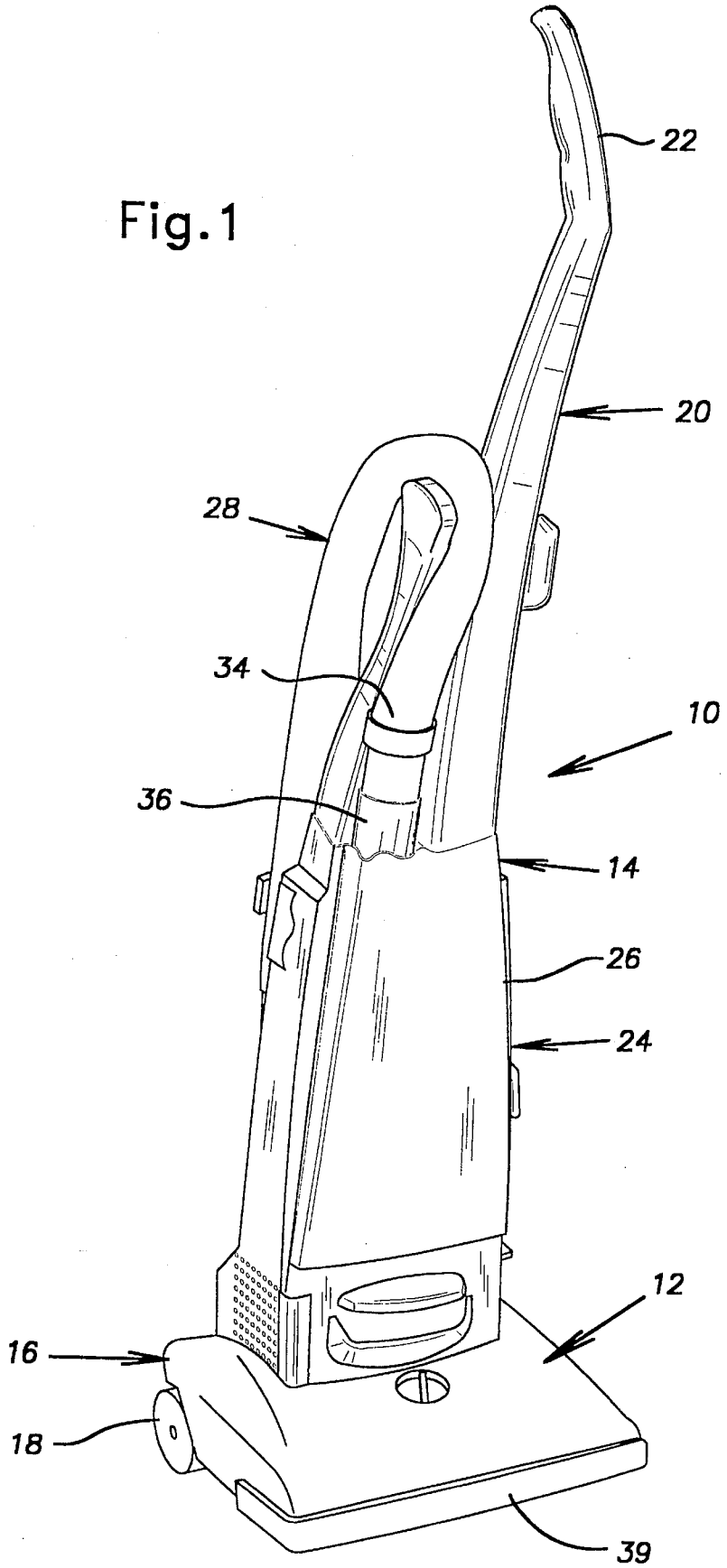
FIG. 1 is a perspective view of a vacuum cleaner according to the present invention.
Figure 2:
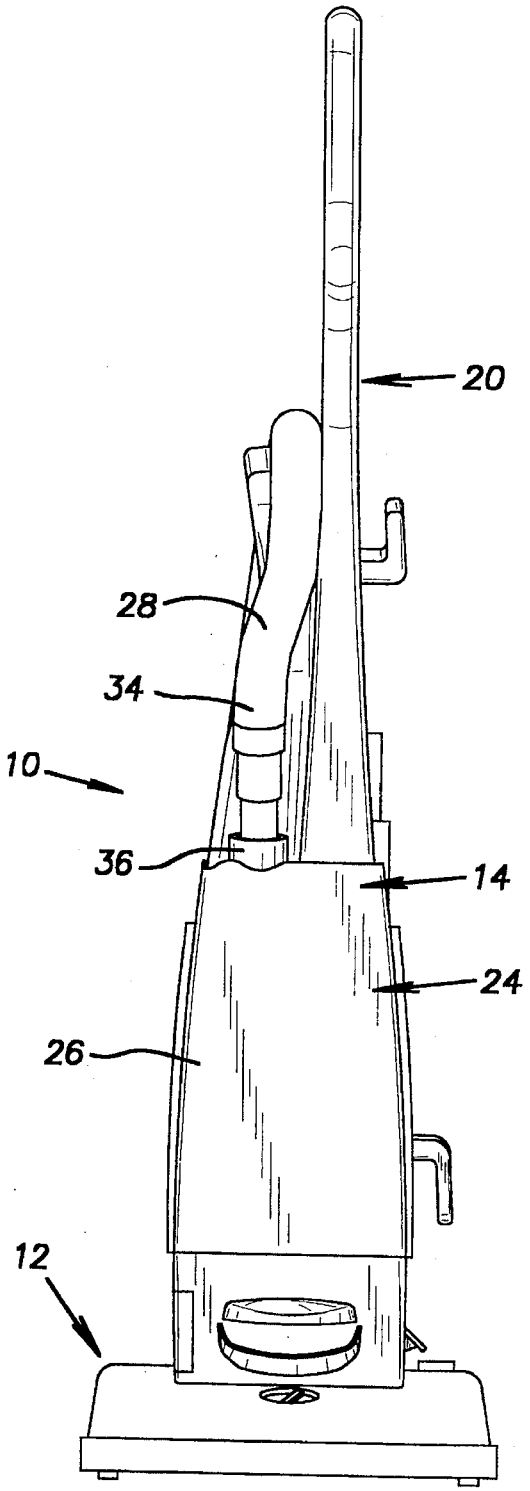
FIG. 2 is a front elevational view of the vacuum cleaner.
Figure 3:
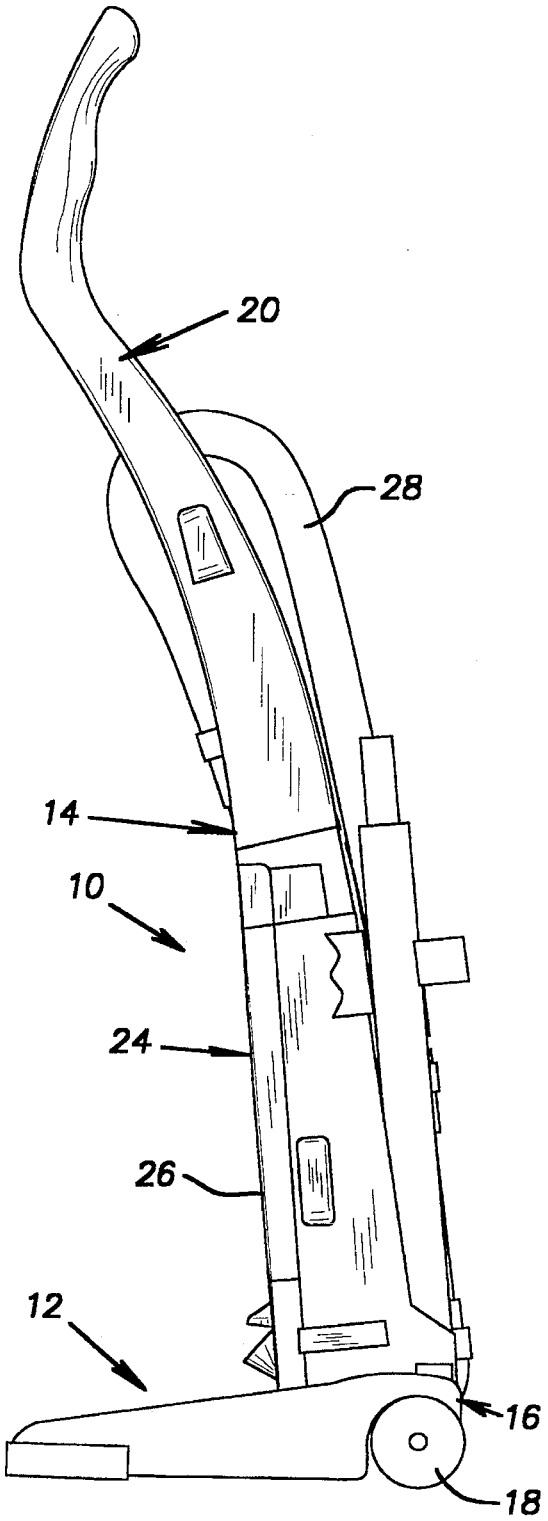
FIG. 3 is a side view of the vacuum cleaner.
Figure 5:
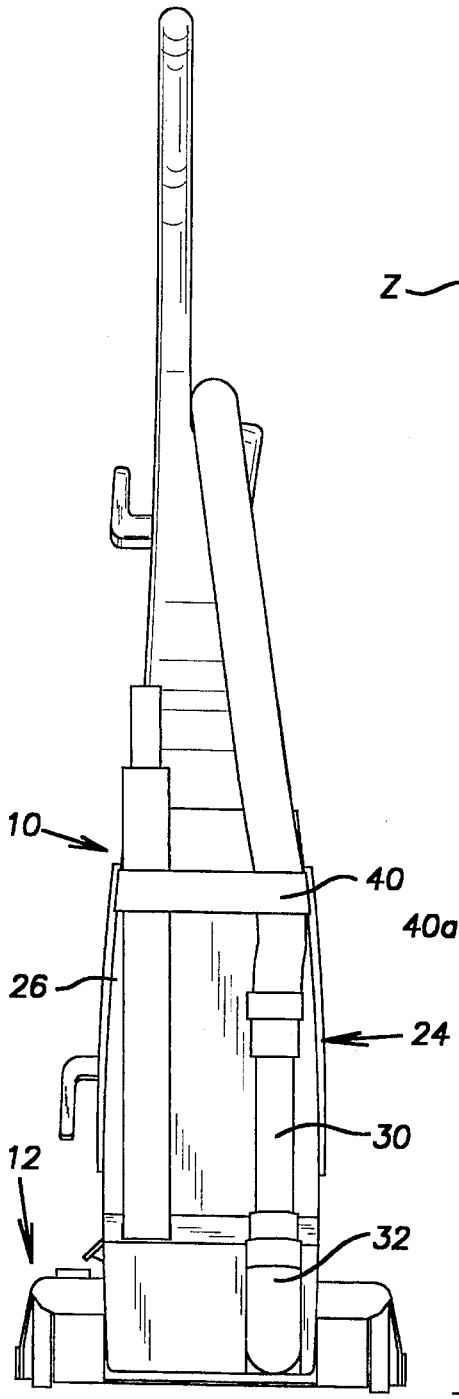
FIG. 5 is a rear view of the vacuum cleaner.

Referring now to the drawings, there is illustrated an upright vacuum cleaner 10 comprising a wheeled, floor-engaging suction housing 12 and a handle 14 pivotally connected to a rear portion 16 of the housing 12.

The housing 12 is supported by a pair of rear wheels 18 and a pair of front wheels (not shown) which allow the vacuum cleaner to roll along the floor surface to be cleaned. A rotatable brush roller (not shown) is mounted in the front of the housing 12. The front wheels are pivotally vertically adjustable to allow the brush roller to operate at the proper height for the carpet being cleaned.

A motor (not shown) is mounted in the housing 12 and is employed to rotate the brush roller. The motor is connected to the brush roller by means of a belt (not shown). The brush roller loosens dirt on the surface in a conventional manner, and the dirt is drawn in an air stream through a passageway in the housing 12.

The handle 14 includes an upper portion 20 having a hand grip 22 and a lower portion 24 which comprises a dirt box 26. The dirt box 26 houses a suction motor (not shown) which draws air from an open mouth of the housing 12 adjacent the brush roll through a suction passageway into the dirt box 26. The dirt box 26 may house a disposable filter bag which receives dirt from the surface being cleaned.

An accessory hose 28 is mounted on the vacuum cleaner 10 at all times, permitting easy access to accessories during the performance of cleaning tasks without the necessity of repeatedly connecting and disconnecting the accessory hose. The hose 28 has one end 30 connected to a coupling 32 which communicates with the interior of the dirt box 26 and another end 34 slidably received in a storage socket 36. The end 34 is adapted to receive various attachments 38 which are removably mounted on a tool caddy 40 on the rear of the dirt box.

Figure 4:
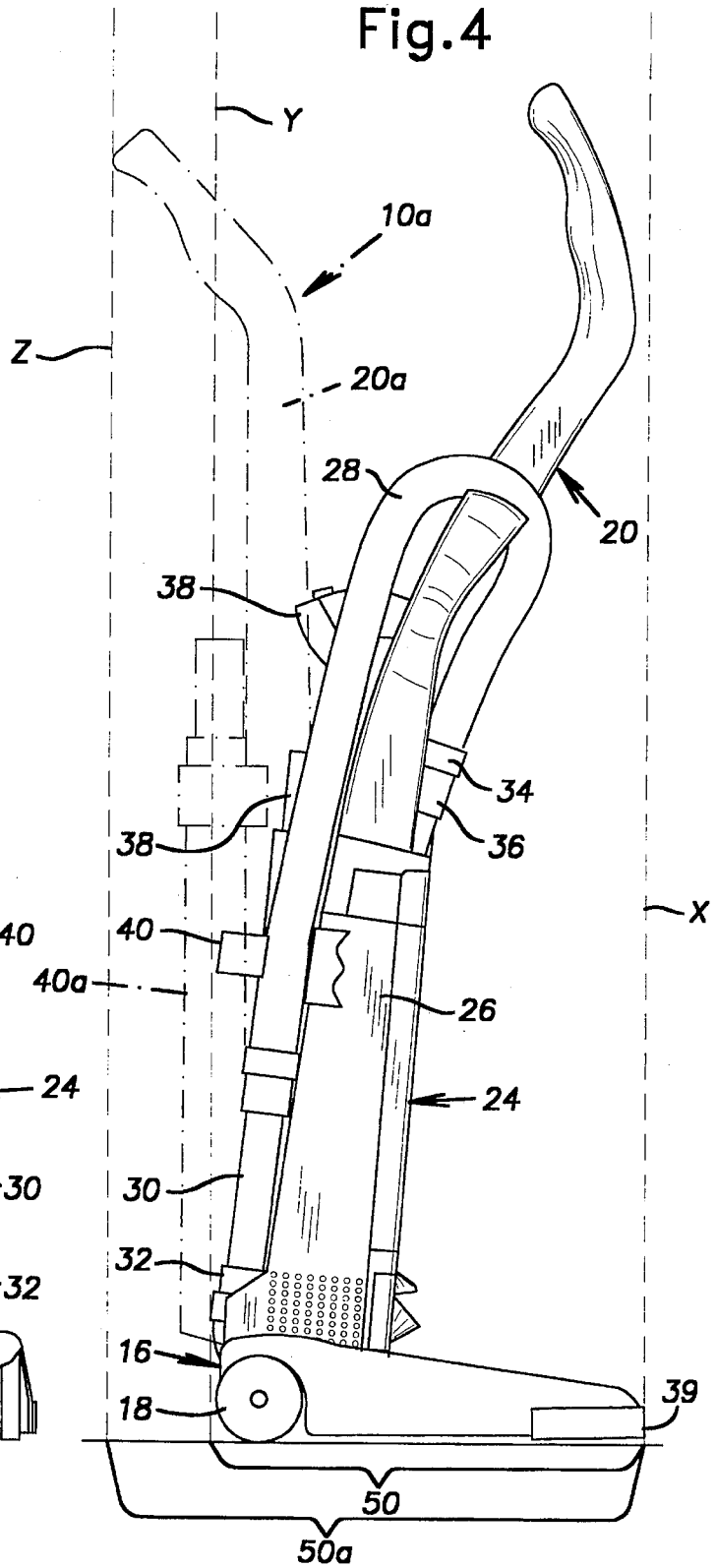
FIG. 4 is a view of the opposite side of the vacuum cleaner illustrating a conventional handle superimposed thereon and in phantom outline.

As may be noted particularly in FIG. 4, the lower portion 24 of the handle 20 is relatively straight and has a longitudinal axis canted slightly forward with respect to a line perpendicular to the surface to be cleaned with the handle in an upright position. The upper portion 22 of the handle curves forward or is canted with respect to the longitudinal axis of the lower portion of the handle and toward an imaginary plane X defined by a leading edge 39 of the housing 12. As may be seen in FIG. 4, Substantially the entire vacuum cleaner 10, including the caddy 40, the housing 12, and the handle 14 is located between the imaginary plane X and an imaginary plane Y which extends perpendicularly from the rear portion 16 of the housing 12. Superimposed on FIG. 4 in phantom outline is a handle 20*a* and its associated tool caddy 40*a* of a conventional prior art vacuum cleaner 10*a*. It may be noted that the handle 20*a* and the tool caddy 40*a* are located between an imaginary plane Z and the plane X, and that the distance between the plane Z and the plane X is greater than the distance between the plane Y and the plane X. This arrangement provides a smaller storage area 50 for the cleaner 10, as compared to a storage area 50*a* for the cleaner 10*a*.

Referring now to FIG. 6, there is illustrated the vacuum cleaner 10 with its handle 14 in a fully lowered position for cleaning under articles of furniture. It may be noted that the hand grip 22 is located substantially above a vertical profile dimension P of the housing 12. It may be also noted in FIG. 6 that a handle 14*a* of a conventional vacuum cleaner 10*a* (which is superimposed on the cleaner 10) has a hand grip 22*a* which is substantially adjacent the surface S when the handle 20*a* is in a completely lowered position for a low-clearance cleaning operation. The handle portion 22, on the other hand, is at a level which helps relieve stress in back and leg muscles when the cleaner is operated under low clearance articles of furniture.

Referring now to FIG. 7, the vacuum cleaner 10 is illustrated in its operating position where the hand grip 22 is positioned at a level which may be comfortably gripped by the operator. Superimposed on the vacuum cleaner 10 is the vacuum cleaner 10*a*, having a conventional handle 14*a*. It may be noted that if the hand grip 22*a* is maintained at the level of the hand grip 22, the axis of the handle 14*a* defines a greater acute angle than the axis of the handle 14 with respect to the surface to be cleaned. Thus, it may be appreciated that the handle 14, during a forward stroke of the cleaner in normal use, has a lesser downward-directed force vector and a correspondingly greater forward force vector, as compared to the corresponding force vectors of the handle 20*a*.

Although the preferred embodiments of this invention have been shown and described, it should be understood that various modifications and rearrangements of the parts may be resorted to without departing from the scope of the invention as disclosed and claimed herein.

What is claimed is:

1. An upright vacuum cleaner comprising a wheeled, floor-engaging suction housing having a rear portion and a front edge and a handle having a lower portion and an upper portion, said lower portion being pivotally connected to said rear portion of said housing and defining a rigid chamber for receiving material from said suction housing, said housing having a relatively low vertical profile for ease of cleaning under articles of furniture, said lower portion of said handle being relatively straight and having a longitudinal axis, said upper portion of said handle having a front wall curving upwardly and forwardly from the rigid chamber and from the longitudinal axis of said lower portion in the direction of said front edge of said housing and further having an end with a hand grip portion thereon angularly related to said upper portion, said handle being pivotable between a fully upright position with said longitudinal axis in a substantially vertical position and a fully lowered position with said longitudinal axis in a substantially horizontal position, said hand grip portion being positioned substantially vertically above the front edge of said housing with said handle in said upright position and being at a level substantially above the vertical profile of said housing with said handle in said substantially horizontal position.

2. An upright vacuum cleaner according to claim 1, wherein a tool caddy is provided on said rigid chamber and defines a series of pockets for storage of on-board tools.

* * * * *